US007150317B2

(12) United States Patent
Barolak et al.

(10) Patent No.: US 7,150,317 B2
(45) Date of Patent: Dec. 19, 2006

(54) USE OF ELECTROMAGNETIC ACOUSTIC TRANSDUCERS IN DOWNHOLE CEMENT EVALUATION

(75) Inventors: Joseph Barolak, Spring, TX (US); Alexei Bolshakov, Pearland, TX (US); Vladimir Dubinsky, Houston, TX (US); Douglas Patterson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 300 days.

(21) Appl. No.: 10/802,612

(22) Filed: Mar. 17, 2004

(65) Prior Publication Data

US 2005/0205248 A1 Sep. 22, 2005

(51) Int. Cl.
*E21B 47/16* (2006.01)

(52) U.S. Cl. ..... 166/254.2; 166/66.5

(58) Field of Classification Search ..... 166/253.1, 166/254.2, 66.5
See application file for complete search history.

(56) References Cited

U.S. PATENT DOCUMENTS 2,660,249 A * 11/1953 Jakosky ..... 166/60
3,221,548 A * 12/1965 Wilson ..... 73/152.15
3,512,407 A * 5/1970 Zill ..... 73/152.15
3,724,589 A * 4/1973 Chapman, III ..... 367/30
4,434,663 A 3/1984 Peterson et al.
4,805,156 A 2/1989 Attali et al.
5,089,989 A 2/1992 Schmidt et al.
5,763,773 A 6/1998 Birchak et al.
6,081,116 A * 6/2000 Wu et al. ..... 324/303
6,176,132 B1 1/2001 MacLauchlan
2003/0043055 A1* 3/2003 Schultz et al. ..... 340/856.3
2004/0117119 A1* 6/2004 West et al. ..... 702/6

* cited by examiner

*Primary Examiner*—William Neuder
(74) *Attorney, Agent, or Firm*—Timothy Donoughue; Keith R. Derrington

(57) ABSTRACT

A bond log device comprising a sonde, an acoustic transducer, and an acoustic receiver. The acoustic transducer is comprised of a magnet combined with a coil, where the coil is energizable by an electrical current source. The acoustic transducer can also be comprised of an electromagnetic acoustic device. The acoustic transducer is capable of producing various waveforms, including compressional waves, shear waves, transversely polarized shear waves, Rayleigh waves, Lamb waves, and combinations thereof.

53 Claims, 3 Drawing Sheets

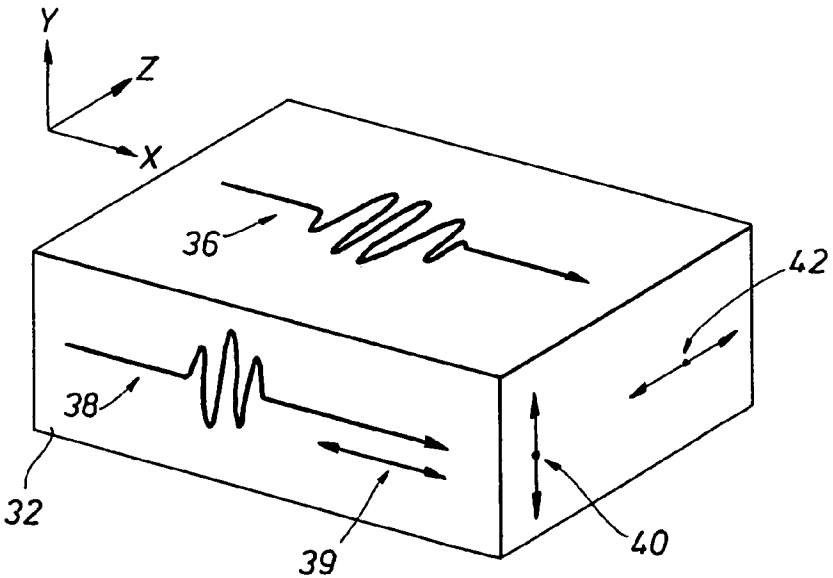
FIG. 5
FIG. 3
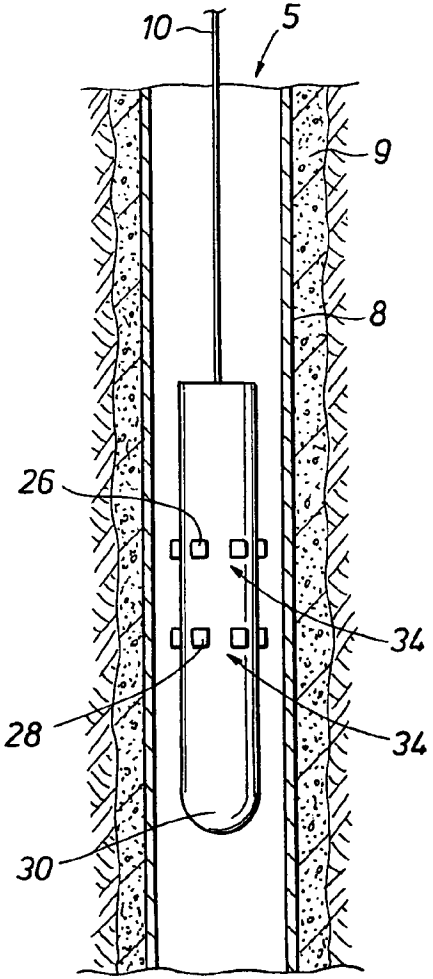

USE OF ELECTROMAGNETIC ACOUSTIC TRANSDUCERS IN DOWNHOLE CEMENT EVALUATION

BACKGROUND OF THE INVENTION

1. Field of the Invention

The invention relates generally to the field of the evaluation of wellbore casing. More specifically, the present invention relates to a method and apparatus to provide for the analysis of the bond that secures casing within a wellbore. Yet even more specifically, the present invention relates to a method and apparatus that enables non-destructive testing of the bond securing casing within a wellbore where the testing includes the production and transmitting of multiple waveforms including compressional waves, shear waves, Lamb waves, Rayleigh waves, and combinations thereof, in addition to the receiving and recording of the waveforms within the casing.

2. Description of Related Art

Hydrocarbon producing wellbores typically comprise casing 8 set within the wellbore 5, where the casing 8 is bonded to the wellbore by adding cement 9 within the annulus formed between the outer diameter of the casing 8 and the inner diameter of the wellbore 5. The cement bond not only adheres the casing 8 within the wellbore 5, but also serves to isolate adjacent zones (Z1 and Z2) within the formation 18 from one another. Isolating adjacent zones can be important when one of the zones contains oil or gas and the other zone includes a non-hydrocarbon fluid such as water. Should the cement 9 surrounding the casing 8 be defective and fail to provide isolation of the adjacent zones, water or other undesirable fluid can migrate into the hydrocarbon-producing zone thus diluting or contaminating the hydrocarbons within the producing zone.

To detect possible defective cement bonds, downhole tools 14 have been developed for analyzing the integrity of the cement 9 bonding the casing 8 to the wellbore 5. These downhole tools 14 are lowered into the wellbore 5 by wireline 10 in combination with a pulley 12 and typically include transducers 16 disposed on their outer surface formed to be acoustically coupled to the fluid in the borehole. These transducers 16 are generally capable of emitting acoustic waves into the casing 8 and recording the amplitude of the acoustic waves as they travel, or propagate, across the surface of the casing 8. Characteristics of the cement bond, such as its efficacy and integrity, can be determined by analyzing the attenuation of the acoustic wave.

Typically the transducers 16 are piezoelectric devices having a piezoelectric crystal that converts electrical energy into mechanical vibrations or oscillations that can be transmitted to the casing 8 thereby forming acoustic waves in the casing 8. To operate properly however, piezoelectric devices must be coupled with the casing 8. Typically coupling between the piezoelectric devices and the casing 8 requires the presence of a coupling medium between the device and the wall of the casing 8. Coupling mediums include liquids that are typically found in wellbores. When coupling mediums are present between the piezoelectric device and the casing 8 they can communicate the mechanical vibrations from the piezoelectric device to the casing 8. Yet, lower density fluids such as gas or air and high viscosity fluids such as some drilling muds cannot provide adequate coupling between a piezoelectric device and the casing 8. Furthermore, the presence of sludge, scale, or other like matter on the inner circumference of the casing 8 can detrimentally affect the efficacy of a bond log with a piezoelectric device. Thus for piezoelectric devices to provide meaningful bond log results, they must be allowed to cleanly contact the inner surface of the casing 8 or be employed in wellbores, or wellbore zones, having liquid within the casing 8.

Another drawback faced when employing piezoelectric devices for use in bond logging operations involves the limitation of variant waveforms produced by these devices. Fluids required to couple the wave from the transducer to the casing with only effectively conduct compressional waves, thus limiting the wave types that can be induced in the casing, although many different types of acoustical waveforms are available that could be used in evaluating casing, casing bonds, and possibly even conditions in the formation 18.

Currently devices do exist that can detect flaws or failures within a wellbore casing, such as scaling, pitting, or other potentially weak spots within the casing. These devices create a magnetic field that permeates the casing, such that an inconsistency of material within the casing, such as potential weak spots, can be identified. Application of these devices is limited to conducting an evaluation of only the wellbore casing itself.

Therefore, there exists a need for the ability to conduct bond logging operations without the presence of a needed couplant. Furthermore, a need exists for a bond logging device capable of emitting numerous types of waveforms.

BRIEF SUMMARY OF THE INVENTION

The present invention includes a tool disposable within a wellbore casing comprising a electromagnetic coupling transducer comprising a coil and a magnet. The coil and the magnet are combinable to couple the wellbore casing with the transducer, where the transducerized couple can induce acoustic energy through the wellbore casing, can record acoustic energy from the wellborn casing, or both. Optionally, the magnetic coupling transmitter is an electromagnetic acoustic transducer. The magnetic coupling transmitter and the receiver can be disposed onto the housing. The tool can further comprise a sonde formed to house the magnetic coupling transmitter and the receiver, the tool can be insertable within the wellbore casing. Optionally included with the tool is an electrical source capable of providing an electrical current to the coil as well as a recorder circuit used to receive the recorded acoustic signals recorded by the transducer.

The term "magnet" as used in reference to the present invention is used in its commonly understood manner to mean any device that creates a magnetic field. A magnet may be selected from the group consisting of a permanent magnet, a direct current electro-magnet, an alternating current electro-magnet, or any other device creating a magnetic field as are well appreciate in the art.

The magnetic coupling transmitter/receiver is capable of forming/receiving a wave within the casing. Such a wave may include (without limitation) waves selected from the group consisting of compressional waves, shear waves, transversely polarized shear waves, Lamb waves, Rayleigh waves, and combinations thereof.

The magnetic coupling transmitter and the receiver can be disposed at substantially the same radial location with respect to the axis of the housing. Alternatively, the magnetic coupling transmitter and the receiver can be disposed at varying radial locations with respect to the axis of the housing. Alternatively the magnetic coupling transmitter and the receiver can be disposed at substantially the same location along the length of the housing. The magnetic coupling transmitter and the receiver can be disposed at different locations along the length of the housing. Two or more rows of acoustic devices can be disposed radially with respect to the axis of the housing, wherein the acoustic devices include at least one magnetic coupling transmitter and at least one receiver. Optionally, these rows can be staggered or can be substantially helically arranged. The device of the present invention is useful to determine the characteristics of a wellbore casing, a bond adhering the wellbore casing to the wellbore, and the formation surrounding the wellbore.

The present invention includes a method of inducing an acoustic wave through a casing disposed within a wellbore. One embodiment of the present method involves combining a magnetic field with an electrical field to the casing thereby inducing acoustic energy through the casing, the acoustic energy propagating through the wellbore casing; and analyzing the acoustic energy propagating through the wellbore. The acoustic energy that propagates through the wellbore can be evaluated to determine characteristics of the casing, the casing bond, and the formation surrounding the wellbore. The method of the present invention can further comprise forming the magnetic field and the electrical field with a magnetically coupled transducer and receiving acoustic energy emanating from the casing with a receiver. The method can also include adding an electrical source to the coil and adding a receiver circuit to the device.

Additionally, the magnetically coupled transducer of the present method can comprise a magnet and a coil, wherein the magnet is selected from the group consisting of a permanent magnet, a direct current electromagnet, and an alternating current electromagnet. Further, the magnetically coupled transducer can be an electromagnetic acoustic transducer. With regard to the present method, waves resulting from the acoustic energy induced by the combination of the magnetic field with the electrical field include those selected from the group consisting of compressional waves, shear waves, transversely polarized shear waves, Lamb waves, Rayleigh waves, and combinations thereof.

Additionally, the method of the present invention can include including the magnetically coupled transducer with the receiver onto a sonde disposed within the casing, wherein the sonde is in operative communication with the wellbore surface. The magnetic coupling transmitter and the receiver can be disposed at substantially the same radial location with respect to the axis of the casing.

Optionally, in the method of the present invention, the magnetic coupling transmitter and the receiver can be disposed at varying radial locations with respect to the axis of the casing. Further, the magnetic coupling transmitter and the receiver can be disposed at substantially the same location along the length of the casing or can be disposed at different locations along the length of the casing. The method can further include disposing two or more rows radially with respect to the axis of the casing, wherein each of the two or more rows includes at least one magnetic coupling transmitter and at least one receiver, each of the two or more rows can be staggered or can be helically arranged.

Accordingly, one of the advantages provided by the present invention is the ability to conduct casing bond logging activities in casing irrespective of the type of fluid within the casing and irrespective of the conditions of the inner surface of the casing. An additional advantage of the present invention is the ability to induce numerous waveforms within the casing, combinations of waveforms within the casing, and simultaneous waveforms within the casing.

BRIEF DESCRIPTION OF THE SEVERAL VIEWS OF THE DRAWING

FIG. 3 shows one embodiment of the present invention disposed within a wellbore.

FIG. 5 illustrates a compressional wave waveform along with a shear wave waveform propagating through a section of wave medium.

DETAILED DESCRIPTION OF THE INVENTION

Figure 1:
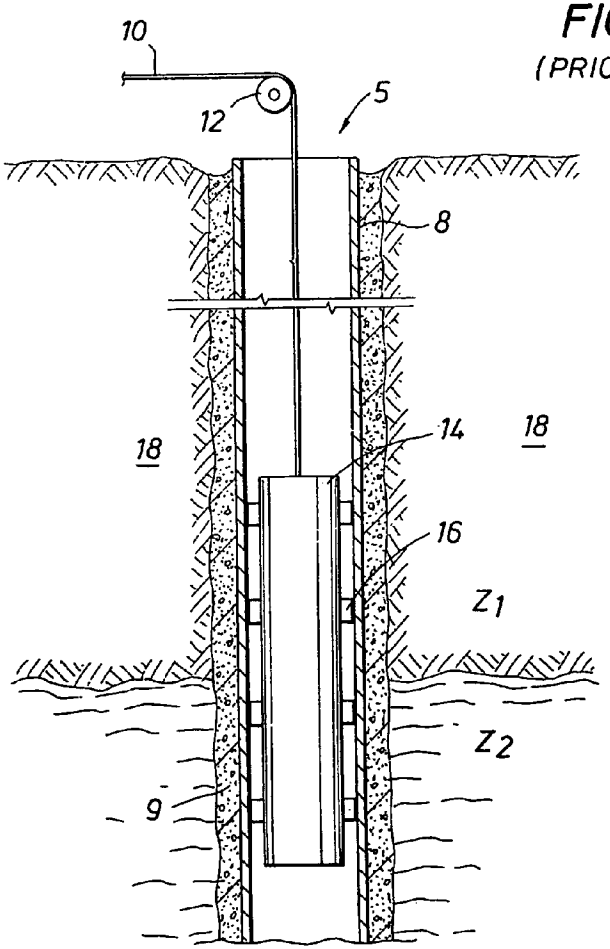
FIG. 1 (PRIOR ART)
FIG. 1 depicts a partial cross section of prior art downhole cement bond log tool disposed within a wellbore.
Figure 2:
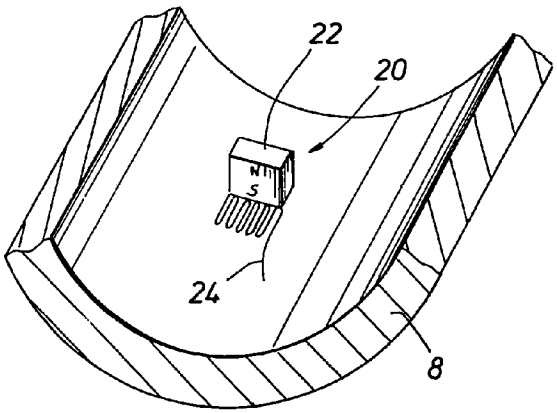
FIG. 2 illustrates a magnetic coupling transmitter disposed proximate to a section of casing.

With reference to the drawing herein, one embodiment of a magnetically coupled transducer 20 proximate to a section of casing 8 is depicted in FIG. 2. For the purposes of clarity, only a portion of the length and diameter of a section of casing 8 is illustrated and the magnetically coupled transducer 20 is shown in exploded view. It is preferred that the magnetically coupled transducer 20 be positioned within the inner circumference of the tubular casing 8, but as is noted below, the magnetically coupled transducer 20 can be positioned in other areas.

In the embodiment of the present invention shown in FIG. 2, the magnetically coupled transducer 20 is comprised of a magnet 22 and a coil 24, where the coil 24 is positioned between the magnet 22 and the inner circumference of the casing 8. An electrical current source (not shown) is connectable to the coil 24 capable of providing electrical current to the coil 24. The magnet 22, while shown as a permanent magnet, can also be an electro-magnet, energized by either direct or alternating current. As will be described in more detail below, energizing the coil 24 when the magnetically coupled transducer 20 is proximate to the casing 8 couples the transducer 20 with the casing 8. More specifically, energizing the coil 24 while the magnetically coupled transducer 20 is proximate to the casing 8 couples acoustic energy within the casing 8 with electrical current that is communicable with the coil 24. In one non-limiting example, the electrical current can be within a wire attached to the coil 24. Coupling between the transducer 20 and the casing 8 can produce acoustic energy (or waves) within the material of the casing 8—which is one form of coupling. Accordingly, the magnetically coupled transducer 20 can operate as an acoustic transmitter when inducing acoustic energy within the casing 8.

Coupling between the magnetically coupled transducer 20 and the casing 8 also provides the transducer 20 the ability to sense acoustic energy within the casing 8. Thus the magnetically coupled transducer 20 can also operate as a receiver capable of sensing, receiving, and recording acoustic energy that passes through the casing 8—which is another form of coupling considered by the present invention. For the purposes of simplicity, the magnetically coupled transducer 20 can also be referred to herein as an acoustic device. As such, the transducerizing couple between the acoustic devices of the present invention and the casing 8 enables the acoustic devices to operate as either acoustic transmitters 26 or acoustic receivers 28, or both.

In the embodiment of the invention depicted in FIG. 3, a sonde 30 is shown having acoustic devices disposed on its outer surface. The acoustic devices comprise a series of acoustic transducers 26 and acoustic receivers 28, where the distance between each adjacent acoustic device on the same row is preferably substantially the same. With regard to the configuration of acoustic transducers 26 and acoustic receivers 28 shown in FIG. 3, while the rows 34 radially circumscribing the sonde 30 can comprise any number of acoustic devices (i.e. transducers 26 or receivers 28), it is preferred that each row 34 consist of 5 or more of these acoustic devices. Preferably the acoustic transducers 26 are magnetically coupled transducers 20 of the type of FIG. 2 comprising a magnet 22 and a coil 24. Optionally, the acoustic transducers 26 can comprise electromagnetic acoustic transducers.

Referring now again to the configuration of the acoustic transducers 26 and acoustic receivers 28 of FIG. 3, the acoustic transducers 26 and acoustic receivers 28 can be arranged in at least two rows where each row comprises devices acting primarily as acoustic transducers 26 and the next adjacent row comprises devices acting primarily as acoustic receivers 28. Optionally, as shown in FIG. 3, the acoustic devices within adjacent rows in this arrangement are aligned in a straight line along the length of the sonde 30.

While only two rows 34 of acoustic devices are shown in FIG. 3, any number of rows 34 can be included depending on the capacity of the sonde 30 and the particular application of the sonde 30. It is well within the scope of those skilled in the art to include the appropriate number of rows 34 and spacing of the acoustic devices. One possible arrangement would include a sonde 31 having one row of devices acting primarily as acoustic transducers 26 followed by two rows 34 of devices acting primarily as acoustic receivers 28 followed by another row 34 of devices acting primarily as acoustic transducers 26. One of the advantages of this particular arrangement is the ability to make a self-correcting attenuation measurement, as is known in the art.

Figure 4A:
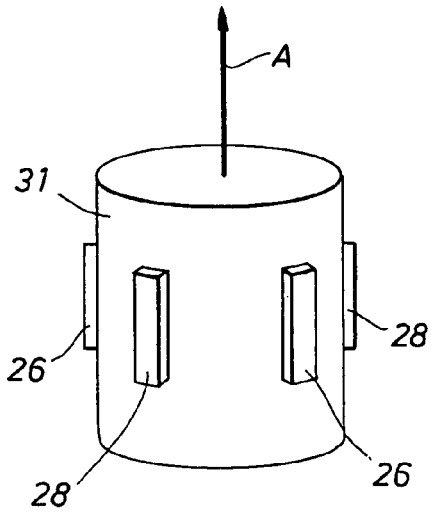
FIGS. 4A–4D depict alternative embodiments of the present invention.
Figure 4B:
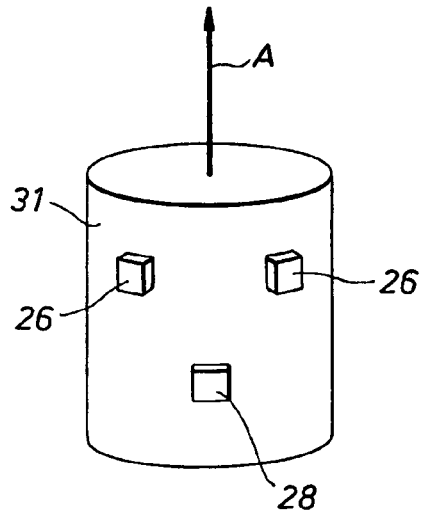

Additional arrangements of the acoustic transducers 26 and acoustic receivers 28 disposed around a segment of the sonde 31 are illustrated in a series of non-limiting examples in FIGS. 4A through 4D. In the embodiment of FIG. 4A a row of alternating acoustic transducers 26 and acoustic receivers 28 is disposed around the sonde section 31 at substantially the same elevation. Preferably the acoustic devices are equidistantly disposed around the axis A of the sonde section 31. In the alternative configuration of the present invention shown in FIG. 4B, the acoustic devices are disposed in at least two rows around the axis A of the sonde section 31, but unlike the arrangement of the acoustic devices of FIG. 3, the acoustic devices of adjacent rows are not aligned along the length of the sonde 30, but instead are somewhat staggered.

Figure 4C:
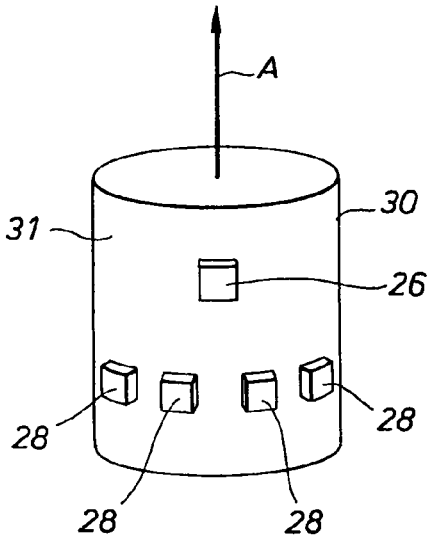
Figure 4D:
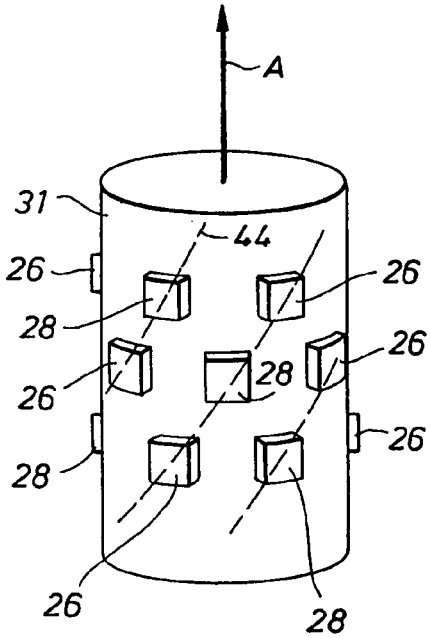

FIG. 4C illustrates a configuration where a single acoustic transducer 26 cooperates with multiple acoustic receivers 28. Optionally the configuration of FIG. 4C can have from 6 to 8 receivers 28 for each transducer 26. FIG. 4D depicts rows of acoustic transducers where each row comprises a series of alternating acoustic transducers 26 and acoustic receivers 28. The configuration of FIG. 4D is similar to the configuration of FIG. 4B in that the acoustic devices of adjacent rows are not aligned but staggered. It should be noted however that the acoustic devices of FIG. 4D should be staggered in a way that a substantially helical pattern 44 is formed by acoustic devices of adjacent rows. The present invention is not limited in scope to the configurations displayed in FIGS. 4A through 4D, instead these configurations can be "stacked" and repeated along the length of a sonde 30. Additionally, while the acoustic devices as described herein are referred to as acoustic transmitters or acoustic receivers, the particular acoustic device can act primarily as a transmitter or primarily as a receiver, but be capable of transmitting and receiving.

In operation of one embodiment of the present invention, a series of acoustic transmitters 26 and acoustic receivers 28 is included onto a sonde 30 (or other downhole tool). The sonde 30 is then be secured to a wireline 10 and deployed within a wellbore 5 for evaluation of the casing 8, casing bond, and/or formation 18. When the sonde 30 is within the casing 8 and proximate to the region of interest, the electrical current source can be activated thereby energizing the coil 24. Providing current to the coil 24 via the electrical current source produces eddy currents within the surface of the casing 8—as long as the coil 24 is sufficiently proximate to the wall of the casing 8. It is within the capabilities of those skilled in the art to situate the coil 24 sufficiently close to the casing 8 to provide for the production of eddy currents within the casing 8. Inducing eddy currents in the presence of a magnetic field imparts Lorentz forces onto the particles conducting the eddy currents that in turn causes oscillations within the casing 8 thereby producing waves within the wall of the casing 8. The coil 24 of the present invention can be of any shape, size, design, or configuration as long as the coil 24 is capable of producing an eddy current in the casing 8.

Accordingly, the magnetically coupled transducer 20 is magnetically "coupled" to the casing 8 by virtue of the magnetic field created by the magnetically coupled transducer 20 in combination with the eddy currents provided by the energized coil 24. One of the many advantages of the present invention is the ability to create a transducerizing couple between the casing 8 and the magnetically coupled transducer 20 without the requirement for the presence of liquid medium. Additionally, these magnetically induced acoustic waves are not hindered by the presence of dirt, sludge, scale, or other like foreign material as are traditional acoustic devices, such as piezoelectric devices.

The waves induced by combining the magnet 22 and energized coil 24 propagate through the casing 8. Moreover, the travel of these acoustic waves is not limited to within the casing 8, but instead can further travel from within the casing 8 through the cement 9 and into the surrounding formation 18. At least a portion of these waves can be reflected upon encountering a discontinuity of material, either within the casing 8 or the area surrounding the casing 8. Material discontinuities include the interface where the cement 9 is bonded to the casing 8 as well as where the cement 9 contacts the wellbore 5. Other discontinuities can be casing seams or defects, or even damaged areas of the casing such as pitting or erosion.

As is known, the waves that propagate through the casing 8 and the reflected waves are often attenuated with respect to the wave as originally produced. Analysis of the amount of wave attenuation of these waves can provide an indication of the integrity of a casing bond (i.e. the efficacy of the cement 9), the casing thickness, and casing integrity. The reflected waves and the waves that propagate through the casing 8 can be sensed and recorded by receiving devices disposed within the wellbore 5. Since the sonde 30 is in operative communication with the surface of the wellbore 5, data representative of the sensed waves can be subsequently conveyed from the receivers to the surface of the wellbore 5 via the wireline 10 for analysis and study.

An additional advantage of the present design includes the flexibility of producing more than one type of waveform.

The use of variable waveforms can be advantageous since one type of waveform can provide analysis data that another type of waveform is not capable of, and vice versa. Thus the capability of producing multiple types of waveforms in a bond log analysis can in turn yield a broader range of bond log data as well as more precise bond log data. With regard to the present invention, not only can the design of the magnet 22 and the coil 24 be adjusted to produce various waveforms, but can also produce numerous wave polarizations.

Referring now to FIG. 5, representations of a compressional-vertical shear (PSV) waveform 38 and a horizontal shear waveform 36 are shown propagating within a wave medium 32. The PSV waveform 38 is comprised of two wave components. One component is a compression wave (P) that has particle motion in the direction of the wave propagation. The other component of the PSV waveform 38 is the shear component that has particle movement in the vertical or y-direction. While both waves propagate in the x-direction, they are polarized in different directions. Polarization refers to the direction of particle movement within the medium 32 caused by propagation of a wave. The compressional polarization arrow 40 depicts the direction of polarization of the compressional waveform 38. From this it can be seen that polarization of the shear wave component of the PSV wave 38 is substantially vertical, or in the y-direction. With regard to the compressional or P component of the PSV wave, its polarization is in the x-direction or along its direction of propagation. The direction of the P wave polarization is demonstrated by arrow 39. Conversely, with reference to the horizontal shear wave 36, its direction of polarization is substantially in the z-direction, or normal to the compressional polarization. The polarization of the horizontal shear wave 36 is illustrated by arrow 42.

The shapes and configurations of these waves are noted here to point out that both of these waveforms can be produced by use of a magnetically coupled transducer 20. Moreover, the magnetically coupled transducers 20 are capable of producing additional waveforms, such as compressional waves, shear waves, transversely polarized shear waves, Rayleigh waves, Lamb waves, and combinations thereof. Additionally, implementation of the present invention enables the production of multiple waveforms with the same acoustic transducer—thus a single transducer of the present invention could be used to simultaneously produce compressional waves, shear waves, transversely polarized shear waves, Rayleigh waves, Lamb waves as well as combinations of these waveforms. In contrast, piezoelectric transducers are limited to the production of compressional waveforms only and therefore lack the capability and flexibility provided by the present invention.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the acoustic receivers 28 or all or a portion of the magnetically coupled transducer 20 can be positioned on a multi-functional tool that is not a sonde 30. Further, these acoustic devices can be secured to the casing 8 as well—either on the inner circumference or outer circumference. These and other similar modifications will readily suggest themselves to those skilled in the art, and are intended to be encompassed within the spirit of the present invention disclosed herein and the scope of the appended claims.

What is claimed is:

1. A tool disposable within a wellbore casing comprising:
an electro-magnetic coupling device comprising a coil and a magnet that is capable of coupling acoustic energy within the wellbore casing and an electrical current communicable with said coil.

2. The tool of claim 1, wherein said coupling comprises inducing acoustic energy through the wellbore casing.

3. The tool of claim 1 wherein said coupling comprises recording acoustic energy received from the wellbore casing.

4. The tool of claim 1 wherein said coupling comprises inducing acoustic energy through the wellbore casing and recording acoustic energy received from the wellbore casing.

5. The tool of claim 1, further comprising a housing insertable within the wellbore casing, said housing adapted to accommodate said electro-magnetic coupling device.

6. The tool of claim 1 further comprising an electrical source capable of providing electrical energy to said coil.

7. The tool of claim 1, further comprising a recording circuit capable of receiving signals recorded by said magnetic recording device.

8. The tool of claim 1, wherein said magnet is selected from the group consisting of a permanent magnet, a direct current electro-magnet, and an alternating current electro-magnet.

9. The tool of claim 1, wherein said electro-magnetic coupling device is capable of forming a wave within the casing, said wave having a waveform selected from the group consisting of compressional waves, shear waves, transversely polarized shear waves, Lamb waves, Rayleigh waves, and combinations thereof.

10. The tool of claim 1, wherein said electro-magnetic coupling device comprises an electromagnetic acoustic transducer.

11. The tool of claim 5 comprising at least two electro-magnetic coupling devices disposed onto said housing.

12. The tool of claim 11, wherein said electro-magnetic coupling devices are disposed at substantially the same radial location with respect to the axis of said housing.

13. The tool of claim 11, wherein said electro-magnetic coupling devices are disposed at varying radial locations with respect to the axis of said housing.

14. The tool of claim 13, wherein said electro-magnetic coupling devices comprise at least one transmitter and at least one receiver, wherein said at least one transmitter is disposed at substantially the same location along the length of said housing and said at least one receiver is disposed at substantially the same location along the length of said housing.

15. The tool of claim 13, wherein said electro-magnetic coupling devices comprise at least one transmitter and at least one receiver, wherein said at least one transmitter and said at least one receiver are disposed at different locations along the length of said housing.

16. The tool of claim 1, further comprising two or more rows of electro-magnetic coupling devices comprising at least one transmitter and at least one receiver disposed radially with respect to the axis of said housing.

17. The tool of claim 16, wherein each of said two or more rows are staggered.

18. The tool of claim 17, wherein each of said at least one transmitter and at least one receiver are substantially helically arranged.

19. The tool of claim 1, wherein the use of said device is selected from the group consisting of analyzing a bond adhering the wellbore casing to the wellbore, analyzing characteristics of the wellbore casing, analyzing characteristics of wellbore cement, and analyzing the formation surrounding the wellbore casing.

20. A cement bond log apparatus comprising:

a housing formed for insertion within a wellbore casing;

a magnetic coupling device disposed within said housing comprising a coil and a magnet, wherein said coil and said magnet are combinable to produce an energy field upon the passing of an electrical energy through said coil thereby magnetically coupling said magnetic coupling transmitter with the wellbore casing thereby capable of forming a transducerizing couple with the wellbore casing.

21. The device of claim 20, wherein said transducerizing couple comprises creating an energy field that is capable of inducing acoustic energy through the wellbore casing.

22. The device of claim 20 wherein said transducerizing couple comprises recording acoustic energy received from the wellbore casing.

23. The device of claim 20 wherein said transducerizing couple comprises creating an energy field that is capable of inducing acoustic energy through the wellbore casing and recording acoustic energy received from the wellbore casing.

24. The bond log device of claim 20 further comprising an electrical source capable of providing electrical energy to said coil.

25. The cement bond log apparatus of claim 20, further comprising a recording circuit capable of receiving signals recorded by said magnetic recording device.

26. The cement bond log apparatus of claim 20, wherein said magnet is selected from the group consisting of a permanent magnet, a direct current electro-magnet, and an alternating current electro-magnet.

27. The cement bond log apparatus of claim 20, wherein said magnetic coupling transmitter is capable of producing a wave having a waveform selected from the group consisting of compressional waves, shear waves, transversely polarized shear waves, Lamb waves, Rayleigh waves, and combinations thereof.

28. The cement bond log apparatus of claim 20, wherein said magnetic coupling transmitter comprises an electromagnetic acoustic transducer.

29. The cement bond log apparatus of claim 20 comprising at least two magnetic coupling devices disposed onto said housing.

30. The device of claim 29, wherein said magnetic coupling devices are disposed at substantially the same radial location with respect to the axis of said housing.

31. The cement bond log apparatus of claim 29, wherein said magnetic coupling devices are disposed at varying radial locations with respect to the axis of said housing.

32. The cement bond log apparatus of claim 31, wherein said magnetic coupling devices comprise at least one transmitter and at least one receiver, wherein said at least one transmitter is disposed at substantially the same location along the length of said housing and said at least one receiver is disposed at substantially the same location along the length of said housing.

33. The cement bond log apparatus of claim 31, wherein said magnetic coupling devices comprise at least one transmitter and at least one receiver, wherein said at least one transmitter and said at least one receiver are disposed at different locations along the length of said housing.

34. The cement bond log apparatus of claim 20, further comprising two or more rows of magnetic coupling devices comprising at least one transmitter and at least one receiver disposed radially with respect to the axis of said housing.

35. The cement bond log apparatus of claim 34, wherein said two or more rows are staggered.

36. The cement bond log apparatus of claim 35, wherein each of said at least one transmitter and at least one receiver are substantially helically arranged.

37. A method of inducing an acoustic wave through a casing disposed within a wellbore comprising:

combining a magnetic field with an electrical field thereby inducing acoustic energy through the casing;

sensing the acoustic energy propagating through the wellbore casing; and analyzing the acoustic energy propagating through the wellbore casing.

38. The method of claim 37 further comprising, forming the magnetic field and the electrical field with a magnetically coupled transducer and receiving the reflected waves with a receiver.

39. The method of claim 38, wherein the magnetically coupled transducer comprises a magnet and a coil.

40. The method of claim 39, wherein said magnet is selected from the group consisting of a permanent magnet, a direct current electro-magnet, and an alternating current electro-magnet.

41. The method of claim 38, wherein the magnetically coupled transducer comprises an electromagnetic acoustic transducer.

42. The method of claim 39 further comprising adding an electrical source to said coil.

43. The method of claim 39 further comprising adding a recording circuit capable of receiving signals recorded by said magnetic recording device.

44. The method of claim 37 wherein the acoustic energy induced by the combination of said magnetic field with said electrical field include acoustic waves selected from the group consisting of compressional waves, shear waves, transversely polarized shear waves, Lamb waves, Rayleigh waves, and combinations thereof.

45. The method of claim 38 wherein said magnetically coupled transducer comprises at least one transmitter and at least one receiver on a sonde disposed within the casing, wherein the sonde is in operative communication with the wellbore surface.

46. The method of claim 45 wherein said magnetic coupling transmitter and said receiver are disposed at substantially the same radial location with respect to the axis of the casing.

47. The method of claim 45 wherein said magnetic coupling transmitter and said receiver are disposed at varying radial locations with respect to the axis of the casing.

48. The method of claim 45 wherein said magnetic coupling transmitter and said receiver are disposed at substantially the same location along the length of the casing.

49. The method of claim 45 wherein said magnetic coupling transmitter and said receiver are disposed at different locations along the length of the casing.

50. The method of claim 37 further comprising two or more rows disposed radially with respect to the axis of the casing, wherein each said two or more rows includes at least one transmitter and at least one receiver.

51. The method of claim 50 wherein said two or more rows are staggered.

52. The method of claim 51 wherein each of said at least one magnetic coupling transmitter and at least one receiver are substantially helically arranged.

53. The method of claim 37 further comprising conducting an analysis selected from the group consisting of analyzing a bond adhering the wellbore casing to the wellbore, analyzing characteristics of the wellbore casing, and analyzing the formation surrounding the wellbore casing.

* * * * *